United States Patent [19]

Simich et al.

[11] 4,055,115

[45] Oct. 25, 1977

[54] BALE-TIE INTERLOCK DEVICE

[75] Inventors: Emil Simich, Chicago; Walter R. Traxinger, Palatine, both of Ill.

[73] Assignee: A. J. Gerrard & Company, Des Plaines, Ill.

[21] Appl. No.: 751,348

[22] Filed: Dec. 14, 1976

[51] Int. Cl.[2] ..... B65B 13/06

[52] U.S. Cl. ..... 100/34; 100/3

[58] Field of Search ..... 100/3, 34, 25, 26, 8, 100/33; 140/101, 111, 114; 24/27

[56] References Cited

U.S. PATENT DOCUMENTS

| | | | |
|---|---|---|---|
| 3,477,363 | 11/1969 | Trumbo | 100/3 X |
| 3,863,297 | 2/1975 | Simich | 100/34 X |
| 3,863,558 | 2/1975 | Trumbo | 100/34 |

*Primary Examiner*—Billy J. Wilhite

*Attorney, Agent, or Firm*—Emrich, Root, O'Keeffe & Lee

[57] ABSTRACT

A bale-tie interlock device for engaging the looped ends of bale-tie wires about a compressed bale in a baling press includes a U-shaped housing having a plate member extending substantially the length of the housing and substantially across the elongated housing opening which defines a bale-tie wire accommodating channel. Slidably positioned within the bale-tie accommodating channel for longitudinal movement is a shuttle member containing a leaf spring. Stop members are mounted in each end of the U-shaped housing to retain the shuttle member within the bale-tie wire accommodating channel. Integrally mounted to one of the sides of the U-shaped housing adjacent one end of the housing is a hook plate member which is engageable with one of the looped ends of the bale-tie wire. Upon the insertion of one looped end into the U-shaped housing, the leaf spring on the shuttle member biases the looped end of the bale-tie wire to cause the looped end to engage the hook plate member. Upon the insertion of the opposite looped end member into the opposite end of the bale-tie accommodating channel, the looped ends are engaged and firmly locked together.

5 Claims, 32 Drawing Figures

FIG. 1
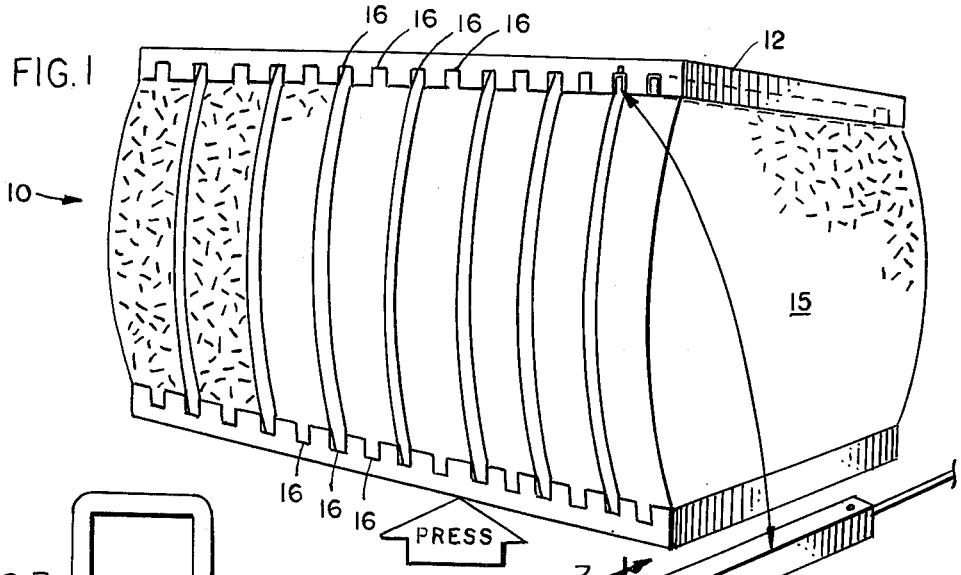
FIG. 3
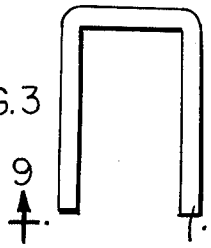
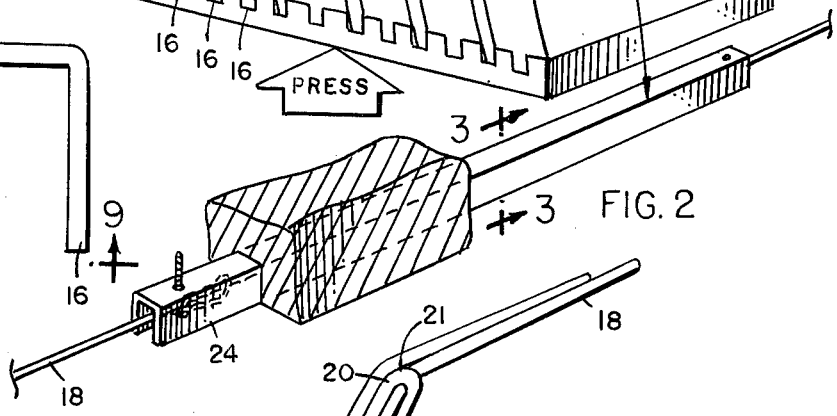
FIG. 2
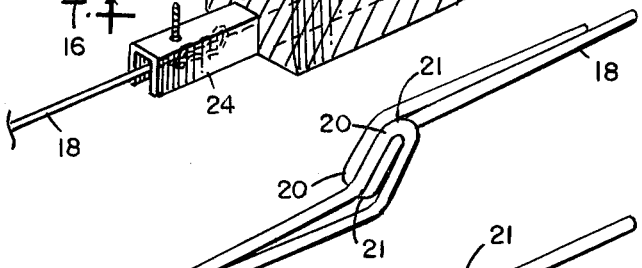
FIG. 4
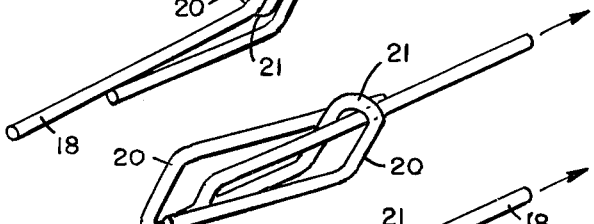
FIG. 5
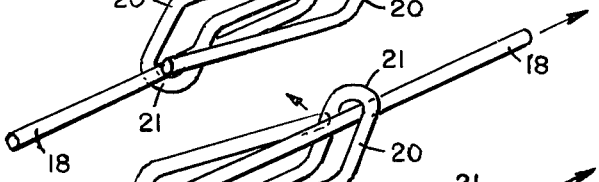
FIG. 6
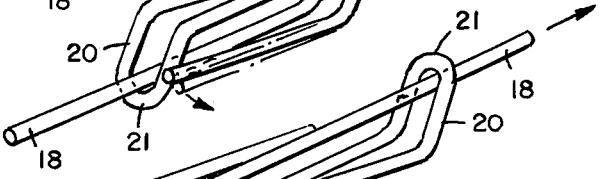
FIG. 7
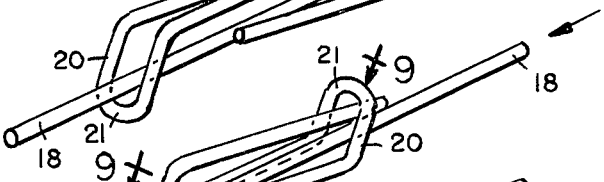
FIG. 8
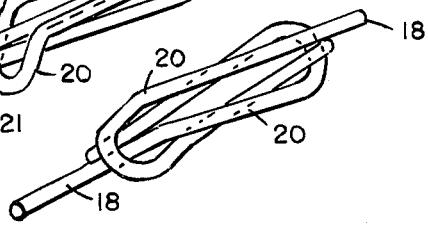
FIG. 9

23
24
25
26
27
28
29
30
31
33
35
39
40
42
45
47
50
51
52

BALE-TIE INTERLOCK DEVICE

BACKGROUND OF THE INVENTION

In the past bale-tie interlocking devices have been positioned in the upper press platen to enable the user thereof to insert the opposite ends of the looped bale-tie wires into the interlocking devices to fully engage the same ends together. Each of these interlocking devices include various means for positioning and holding the looped ends of the bale-tie wires in predetermined positions within the interlocking devices to enable the user thereof to interlock the looped ends together. Once the looped ends have been fully engaged together, the wires are then released to encircle the compressed bale. Many of the interlocking devices have included mechanical dump door arrangements which are designed to permit release of the interlocked bale-tie wire about the compressed bale and have included expensive permanent magnets therein which purportedly aid and assist in aligning the looped ends of the bale-tie wire in proper relationship to permit engagement of the looped ends together. Needless to say, such complicated and expensive mechanical structures are not adaptable to many of the various sized bale-tie accommodating slots in existing baling presses. Additionally, many baling presses involve extremely high pressures and under such conditions the mechanical type devices having moving dump doors and the like are of such flimsy construction that they are immediately deformed during usage and, accordingly, are not adaptable for usage in such high pressure presses. Further attempts to improve such interlocking devices has resulted in hand operated plunger members which engage one of the wires to aid in interlocking the looped ends together. However, such mechanisms are also bulky and are unable to withstand the high pressures in many of the various presses and have not been able to achieve the reproducibility required in interlocking the looped ends of the wires together.

SUMMARY OF THE INVENTION

One object of the present invention is to provide an interlocking device which is adaptable for use in both conventional cotton presses and in high pressure presses.

Another object of the present invention is to provide an improved interlocking device for engaging bale-tie wires about a compressed bale which is inexpensive to manufacture, simple in construction and more efficient in operation than existing bale-tie interlocking devices.

A further object of the present invention is to provide means for mounting interlocking devices in high pressure presses.

The bale-tie interlocking device of the present invention is useful in conjunction with a pair of compressed platens in a baling press for baling material and provides automatic means for engaging the looped ends of bale-tie wires about a compressed bale. Conventional bale-tie wires include loops formed at each end of the wire in opposite directions thereof with a portion of each loop bent out of the plane of each respective loop in the opposite direction thereof. The present interlocking device includes a U-shaped housing having a plate member extending substantially the length thereof and substantially across the U-shaped housing opening which defines a bale-tie wire channel therein. A shuttle member having a leaf spring mounted integral thereto is slidably mounted within the bale-tie wire receiving channel and movable along the length thereof to assist in positioning the inserted looped end of the bale-tie wire in proper relationship to permit engagement thereof with the opposite looped end, as will hereinafter be described. Each end of the U-shaped housing includes stop means mounted thereon to retain the shuttle member within the bale-tie wire accommodating channel. Adjacent one end of the U-shaped housing is an inclined plate member mounted thereto which includes a hook projection element thereon. The hook projection element is engageable with one of the looped ends of the bale-tie wire to hold the same in position to permit the opposite looped end thereof to engage the positioned looped end whereby the looped ends are engaged and interlocked together.

In operation, the bale-tie interlocking device of the present invention is mounted within the bale-tie accommodating channels in the upper press platen of the baling press. One looped end of the bale-tie wire is inserted into the end of the U-shaped housing opposite the end having the inclined plate member thereon. As the looped end is inserted into the elongated bale-tie wire channel, the looped end engages the shuttle member and leaf spring mounted integral thereto. As the looped end is further inserted into the elongated bale-tie wire channel, the leaf spring biases the looped end against the side member of the U-shaped housing. Upon the insertion of the looped end, the leaf spring biases the looped end against the inclined plate member such that upon the further insertion of the looped end into the U-shaped housing, the looped end engages the hook projection element on the inclined plate member and the leaf spring biases and retains the looped end firmly in engagement with the hook projection element. The shuttle lip prevents the loop from dropping out of the device before proper engagement of both loop ends.

As the inserted looped end is firmly retained by engagement with the hook projection element, the opposite looped end is inserted into the opposite end of the elongated channel. As the inserted looped end engages the firmly held looped end, the looped ends are engaged and interlocked together, as is well known in the art. During this engaging and interlocking operation, the shuttle member is slidably moved and is positioned to permit ejection of the engaged loops and also to receive an inserted looped end during the next baling operation.

In a further modification of the present invention, the bale-tie interlock device is mounted by a leaf spring member to the upper press platen of a high pressure baling press. The leaf spring mounting provides resiliency to the interlocking device during the baling operation and eliminates the possibility of deformation of the interlocking device during such high pressure baling operation.

DESCRIPTION OF THE DRAWINGS

FIG. 1 is a perspective view of a baling press incorporating a plurality of devices embodying the principles of the present invention;

FIG. 2 is an enlarged perspective view showing the mounting of the interlocking device of the present invention in the movable press platen;

FIG. 3 is a cross-sectional view of the interlocking device of the present invention taken along line 3—3 of FIG. 2;

FIG. 4 is a fragmentary perspective view showing the looped ends of a bale-tie wire in position for engagement together;

FIG. 5 is a fragmentary perspective view showing the looped ends in partial engaging position;

FIG. 6 is a fragmentary perspective view showing the looped ends in overlapping engaged position;

FIG. 7 is a fragmentary perspective view showing the looped ends in the fully engaged position;

FIG. 8 is a fragmentary perspective view showing the looped ends in a partial interlocked position;

FIG. 9 is a fragmentary perspective view showing the looped ends in the fully interlocked position;

DETAILED DESCRIPTION

Figures 10, 11, 12, 13, 14, 15, 16, 17, 18, 19:
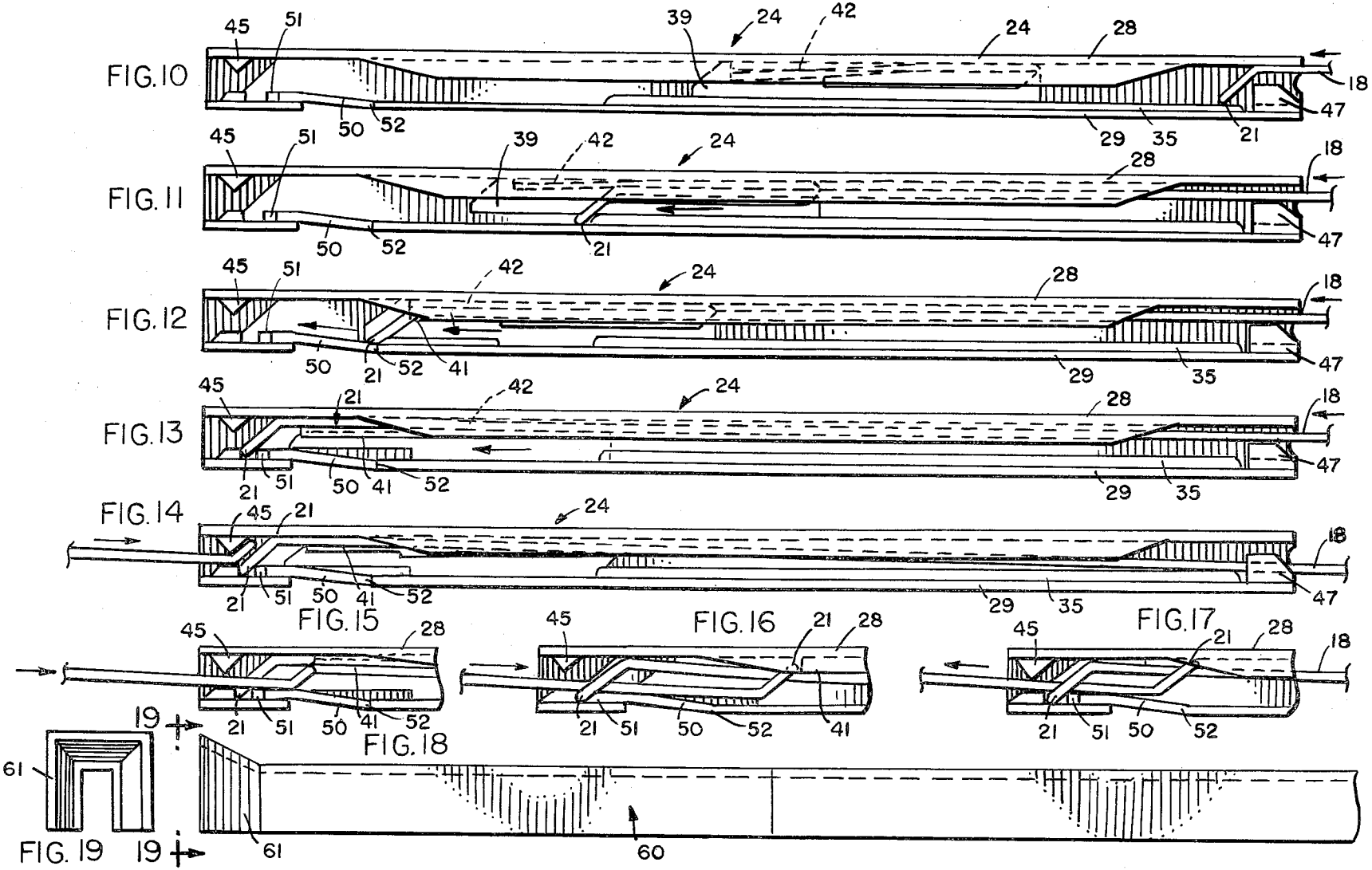
FIG. 10 is a bottom view of the interlocking device of the present invention showing the partial insertion of one looped end of the bale-tie wire into the interlocking device.
FIG. 11 is a bottom view of the device in accordance with the present invention showing the insertion of the looped end of the bale-tie wire in an intermediate position within the interlocking device.
FIG. 12 is a bottom view of the device in accordance with the present invention showing the positioning of the looped end within the interlocking device at the base of the inclined plate member.
FIG. 13 is a bottom view of the device in accordance with the present invention showing the looped end of the bale-tie wire being engaged with the hook member within the interlocking device of the present invention.
FIG. 14 is a bottom view of the device of the present invention showing the insertion of the opposite looped end of the bale-tie wire.
FIG. 15 is a partial bottom perspective view showing the looped ends of the bale-tie wire in partial engaging position in accordance with the present invention.
FIG. 16 is a partial bottom perspective view showing the looped ends of the bale-tie wire in overlapping engaged position in accordance with the present invention.
FIG. 17 is a partial bottom perspective view showing the looped ends of the bale-tie wire in partial interlocked position in accordance with the present invention.
FIG. 18 is a partial cross-sectional view showing the elongated horn member in accordance with the present invention.
FIG. 19 is an end view taken along line 19—19 in FIG. 18.

Referring now to the drawings, wherein like reference numerals are used throughout the several views to identify the same or similar parts, in FIG. 1 there is shown a conventional baling press 10 comprising a stationary or upper base platen 12 and a lower movable platen 14 which may be actuated by a ram or other means (not shown). The lower base platen 14 is movable up and down between an at-rest and a baling position to compress and release a bale of material 15, as is well known in the art. The upper and lower platens 12 and 14 define a press chamber therebetween which is useful in baling material, such as cotton, stable fibers, paper and the like.

Located in each of the upper and lower platens 12 and 14 are a plurality of bale-tie accommodating channels 16, as shown in FIGS. 1, 28, 29 and 30. As shown in FIG. 1, the bale of material 15 is compressed between the upper and lower base platens 12 and 14 and then a plurality of bale-tie wires 18 are inserted about the bale and fastened together to retain and hold the bale of material when the platen is released, as is well known in the art.

As shown in FIGS. 4–9 the bale-tie wire 18 includes a continuous wire strand having a pair of looped ends 20 formed at each end of the wire. The looped ends 20 are formed in opposite directions with respect to each other and each looped end includes an end portion 21 bent out of the plane of each respective loop 21 in opposite directions thereof, as shown in FIG. 4. The looped ends 20 may be engaged and interlocked together, as shown in FIGS. 5–9.

Figures 20, 21, 22, 23, 24, 25, 26, 27:
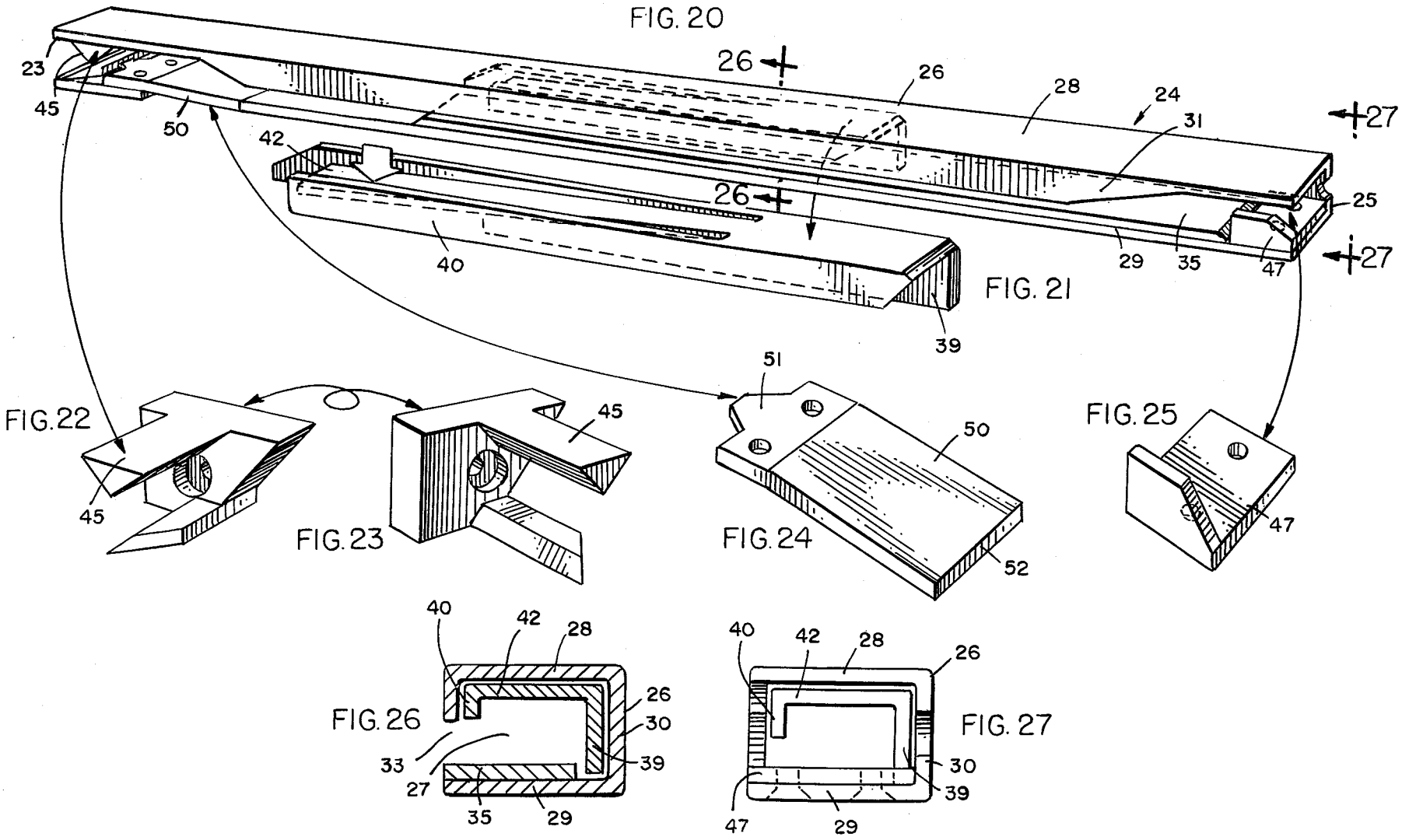
FIG. 20 is a perspective view showing the interlocking device in accordance with the present invention.
FIG. 21 is a perspective view showing the shuttle member in accordance with the present invention.
FIGS. 22 and 23 are perspective views showing the shuttle stop member in accordance with the present invention.
FIG. 24 is a perspective view showing the inclined plate member and hook projection thereon in accordance with the present invention.
FIG. 25 is a perspective view showing the end stop member in accordance with the present invention.
FIG. 26 is a cross-sectional view taken along line 26—26 in FIG. 20.
FIG. 27 is an end view taken along line 27—27 in FIG. 20.

The bale-tie interlock device 24, as shown in FIG. 20, comprises an elongated body or channel member 26 which defines an elongated or bale-tie wire accommodating channel 27 which generally is U-shaped in cross-section and comprised of first and second inner side faces 28 and 29, respectively, and an inner web face 30. A cover or plate member 31 extends substantially the length of the channel member 26 of housing 24 and substantially across the first and second side faces 28 and 29 to define an elongated channel 27 therein. The space 33 between the cover plate 31 and the second side face 29 of the elongated channel member 26 permits the removal of the interlocked bale-tie wire 18 from the interlock device when the lower platen 14 is moved from the baling position to the at-rest position, as will be described.

Integrally mounted substantially along the length of the second side face 29 within the elongated channel 27 of the channel member 26 is a retention plate 35, as shown in FIGS. 20 and 26, and slidably positioned within the elongated channel member 26 is the shuttle member 38. The shuttle member 38 (FIG. 21) is comprised of a base plate 39, a lip plate element 40 having a shuttle lip portion 41 and a leaf spring 42 integrally mounted to the base and the lip plates. As shown in FIG. 26, the leaf spring 42 of the shuttle member 38 is positioned within the elongated U-shaped channel member 26 such that the cover plate member 31 and the retention plate 35 permits the shuttle member 38 to freely slide back and forth along the length of the channel member 26. The leaf spring 42 extends inwardly away from the first side face 28 of the elongated housing 26 to bias the inserted looped end 20 of the bale-tie wire 18 towards the retention plate 35, as will hereinafter be described.

Additionally, the first end 23 of the interlocking device 24 includes a shuttle stop member 45 mounted thereto. The shuttle stop member 45 may be attached by screws or other conventional means to the end 23 to firmly retain the shuttle member 38 within the elongated U-shaped channel member 26. Mounted at the opposite end 25 of the elongated channel member 26 is an L-shaped stop member 47 (FIGS. 25 and 27) which firmly retains the slidable shuttle member 38 within the elongated channel member 26. The L-shaped stop member 47 may also be mounted by screws or other means (not shown) to the elongated channel member 26 in such a manner as to permit periodic removal thereof to aid and assist the user of the interlocking device 24 in periodic cleaning of the device as desired. Mounted to the second side face 29 of the channel member 26 adjacent the shuttle stop member 45 is an inclined plate member 50. The base 52 of the inclined plate member 50 may be mounted flush with the second side face 29 or it may be mounted within the elongated channel member 26. In such an embodiment (not shown) it is desirable to level the base 52 to assist in permitting the end portion 21 of the wire in overcoming the resistance of the plate member 50. The inclined plate 50 terminates and includes a hook projection member 51 which engages the end portion 21 of the looped end 20, as will hereinafter be described.

Figures 28, 29, 30, 31, 32:
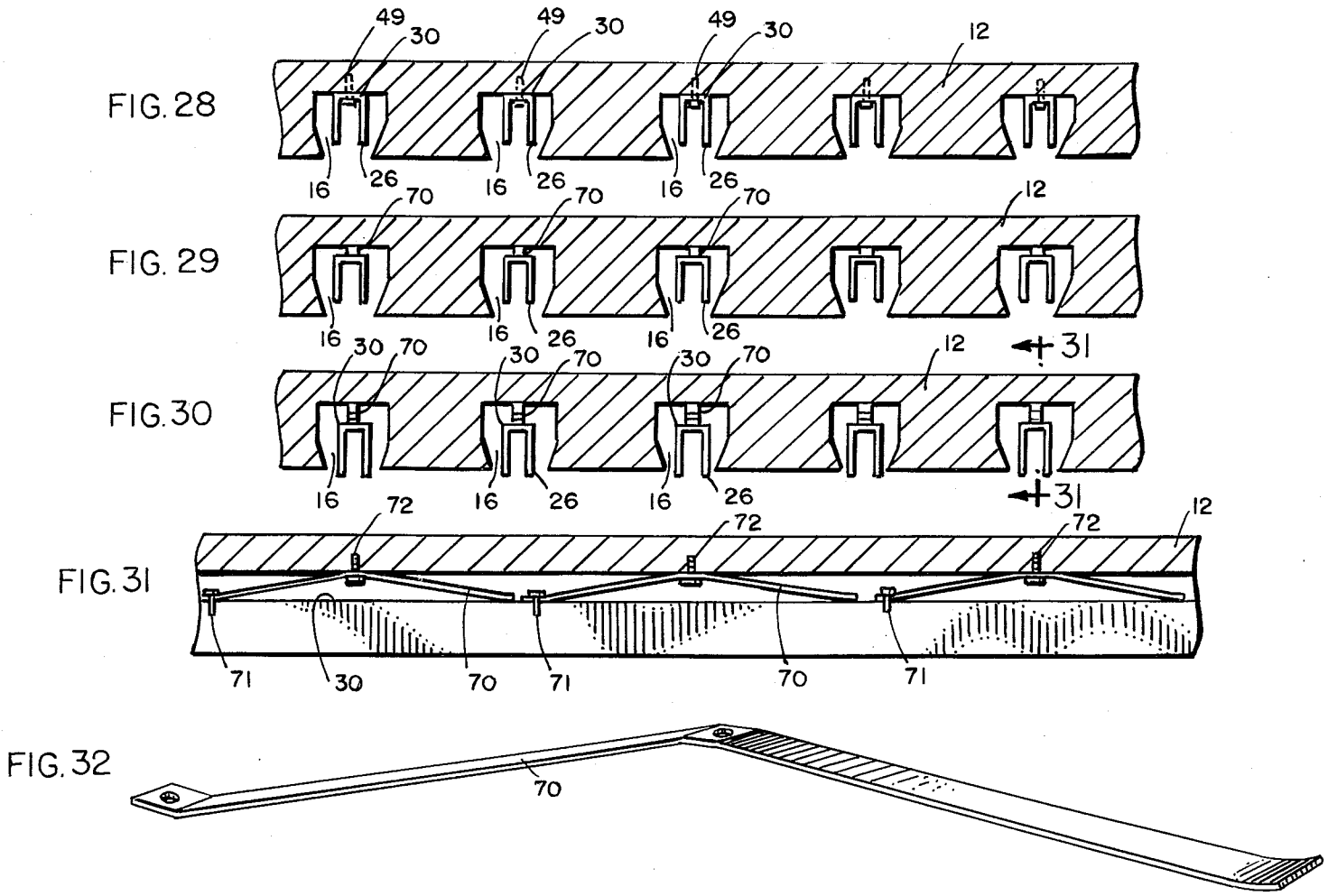
FIG. 28 is a partial cross-sectional view showing the mounting in a conventional cotton gin of the interlocking device in accordance with the present invention.
FIG. 29 is a partial cross-sectional view showing the position of the interlocking device of the present invention in a high pressure baling press platen when the movable platen is in the baling position.
FIG. 30 is a partial cross-sectional view showing the mounting of the interlocking device of the present invention in the movable platen in a high pressure baling press.
FIG. 31 is a cross-sectional view taken along line 31—31 of FIG. 30.
FIG. 32 is a perspective view showing the leaf spring mounting bracket in accordance with the present invention.

As shown in FIG. 28, the interlocking device 24 is mounted to the upper movable platen 12 by the use of bolts 49 which are secured through openings (not shown) in the inner web face 30 of the elongated channel member 26. When the bale-tie interlocking device 24 of the present invention has been mounted in the bale-tie accommodating channel 16 of the upper movable platen 12, the operation of the interlocking device 24 operates as follows:

First, the looped end 20 and the end portion 21 thereon of the bale-tie wire 18 is inserted into opposite end 25 of the elongated channel member 26, as shown in FIG. 10. As the end portion 21 thereof is moved to the left, a position as shown in FIG. 11, the looped end 20 engages the leaf spring 42 on the shuttle member 38 which in turn biases the looped end 20 against the retention plate 35. During the further travel of the looped end 20 with the elongated channel 27, the end portion 21 engages the base 52 of the inclined plate 50, a position as shown in FIG. 12. Upon the further movement of the looped end 20 and the bale-tie wire 18, the end portion 21 rides up the inclined plate 50 to a point wherein the end portion 21 is engaged by the hook projection member 51 and held firmly thereagainst by the leaf spring 42 of the shuttle member 38, a position as shown in FIG. 13. The shuttle lip portion 41 thereby prevents the loop end 21 from dropping out of the device before proper engagement of both loop ends.

Next, the opposite looped end 20 of the bale-tie wire 18 is inserted into the first end 23 of elongated channel member 26 past the shuttle stop member 45, a position as shown in FIG. 14. FIGS. 15–17 further shows the travel of the looped end 20 and end portion 21 of the bale-tie wire 18 and the engagement of the looped ends 20 until the looped ends are fully engaged (FIG. 16). Upon the subsequent return outwardly of looped end 20, the looped ends 20 are fully interlocked together, a position partially shown in FIG. 17, and the shuttle member is slidably moved and positioned to permit ejection of the interlocked loop end also to receive an inserted looped end during the next baling operation. After the looped ends 20 are firmly interlocked together, the upper platen 12 is moved from its downward baling position to its upward at-rest position wherein the bale-tie wire 18 is released from the interlocking device 24 through the opening or space 33 between the cover plate 31 and the second side face 29 of the elongated channel member 26. Thus, the interlocking device 24 is again ready for the next baling operation wherein the looped ends 20 of the bale-tie wire 18 are inserted therein, as has been set forth above.

In FIG. 18, an elongated horn member 60 is shown having a funnel portion 61 mounted integrally thereto. The elongated horn member 60 is designed to be attachable to one or both of the ends 23 and 25 of elongated channel member 26 to aid the user thereof in threading the looped ends 20 of the bale-tie wire 18 into the interlocking device. The horn member 60 is useful when the interlocking device 24 has been mounted to a movable platen 12 having a greater width than the length of the particular interlocking device 24. Thus, the horn member 60 permits the user of the interlocking device 24 to insert the looped ends 20 to the funnel portion 61 and subsequently into the elongated channel 27 thereby insuring that the looped ends are properly directed into the elongated channel 27 to complete the engaging and interlocking operation of the looped ends together, as has previously been described.

In FIGS. 30 and 31, the interlocking device 24 of the present invention is prepared for mounting to an upper platen 12 of a high pressure baling press (not shown). The particular mounting means includes a mounting leaf spring 70 (FIG. 32) mounted by fastening means 71 to the openings (not shown) in the inner web face 30 of the elongated channel member 26. The leaf spring 70 is also attached by fastening means 72 to the upper platen 12 at a point intermediate its length as shown in FIG. 31. The interlocking device 24 is mounted to the upper platen 12, as shown in FIG. 30, when the platen is in its upper at-rest position. When the upper platen 12 is moved downwardly to its baling position, the interlocking device 24 is biased upwardly to a position as shown in FIG. 29. Thus, the resilient mounting means of the present invention permits the interlocking device 24 to be biased upwardly when the device is mounted to a high pressure baling press. This resiliency is necessary to prevent deformation of the interlocking device when the interlocking device 24 is used in very high pressure baling presses.

What has been described is an improved bale-tie interlocking device which provides rapid engagement and interlocking of the looped ends of the bale-tie wires about the compressed bale and which provides reliability which has heretofore been unobtainable with existing interlocking devices. The corresponding saving of time and labor in interlocking and engaging the bale-tie wire about the girth of compressed bales and its adaptability to both convention cotton gin presses and to high pressure baling presses has heretofore been unobtainable with existing interlocking devices.

We claim:

1. A bale-tie interlocking device for use with a baling press having a platen for engaging the looped ends of the bale-tie wires about the girth of a bale, comprising:

a housing defining a channel therein and having a plate member extending substantially the length thereof and substantially thereacross to permit release of the engaged and interlocked looped ends of the bale-tie wire from said housing, shuttle means longitudinally slidable in said housing, shuttle stop means mounted to said housing at one end thereof to thereby retain said shuttle means within said channel, and inclined hook plate means mounted in said channel adjacent said shuttle stop means, such that upon the insertion of one looped end of the bale-tie wire into said housing, said shuttle means biases the looped end against said hook plate means to hold the same, such that upon the insertion of the opposite looped end into said housing, the looped ends are engaged, interlocked together and the shuttle is pushed back to release the engaged looped ends.

2. The bale-tie interlocking device in accordance with claim 1 wherein said shuttle means is comprised of a base plate, a lip plate member and an elongated leaf spring member integrally mounted to said base plate and said lip plate member.

3. A bale-tie wire in accordance with claim 1 further including resilient mounting means mounted to said housing for attaching the interlocking device to the movable platen.

4. The bale-tie interlocking device in accordance with claim 1 further including stop means mounted to said housing and opposite said end having the shuttle stop means.

5. The bale-tie interlocking device in accordance with claim 1 wherein said inclined hook plate means further includes a projection thereon which is engageable with one of the looped ends of the bale-tie wire to hold the same in interlocking position.

* * * * *